United States Patent [19]

Ospelt

[11] Patent Number: 4,989,502

[45] Date of Patent: Feb. 5, 1991

[54] WEATHERPROOFING DOORS FOR THE AIR INTAKE OPENING OF VENTILATING SYSTEMS

[75] Inventor: Gustav Ospelt, Vaduz, Liechtenstein

[73] Assignee: Hoval Interliz AG, Vaduz-Neugut, Liechtenstein

[21] Appl. No.: 427,873

[22] Filed: Oct. 26, 1989

[30] Foreign Application Priority Data

Oct. 26, 1988 [EP] European Pat. Off. ..... 88117801.6

[51] Int. Cl.[5] ..... E06B 7/08

[52] U.S. Cl. ..... 98/87; 98/121.1

[58] Field of Search ..... 98/87, 121.1

[56] References Cited

U.S. PATENT DOCUMENTS

| | | | |
|---|---|---|---|
| 1,677,910 | 7/1928 | Wills | 98/87 |
| 3,086,443 | 4/1963 | Doolittle | 98/87 X |
| 3,358,580 | 12/1967 | Freese et al. | 98/121.1 |
| 3,771,430 | 11/1973 | Lane | 98/121.1 |

*Primary Examiner*—Harold Joyce

*Attorney, Agent, or Firm*—Robert W. Becker & Associates

[57] ABSTRACT

A weatherproofing door for an air inlet opening of a ventilating unit. The door has an upper and a lower horizontal doorframe section that can be pivoted outwardly, about vertical axes, in the housing frame that surrounds the air intake opening. Vertically extending, lamellar profiled drop-extracting members that are disposed next to one another extend between the two horizontal doorframe sections. Between the outer and inner sides of the door, the profiled members have profile curvatures that are laterally directed in the same direction, with the height of the profile curvatures, in a horizontal direction, being at least as great as the horizontal clear distance of the air passages between the profiled members. The lower horizontal doorframe section has a drain that communicates with the air passages.

6 Claims, 2 Drawing Sheets

WEATHERPROOFING DOORS FOR THE AIR INTAKE OPENING OF VENTILATING SYSTEMS

BACKGROUND OF THE INVENTION

The present invention relates to weather-guard or weatherproofing doors for the air inlet or intake openings of a ventilating system.

With ventilating systems that have an air intake that is exposed to the effects of weather, for example in connection with ventilating equipment placed on the roofs of buildings, weatherproofing screens that are disposed in the air inlet opening to prevent the entry of rain must often be embodied as doors in order to enable access through the air inlet opening for maintenance work on components of the ventilation system, such as filters, dampers, fans, servo-motors, etc. Due to the constantly more compact manner of construction of ventilation equipment, increased requirements are established for such rainproof weatherproofing doors for air intakes. The weatherproofing doors that have been conventional up to now, which doors are embodied with the conventional louver-like weatherproofing screen of horizontal extractor fins or ribs, and are sealed at the edges of the door via door gap seals or gaskets relative to the mounting or installation frame that surrounds the air intake opening, do not fulfill these increased requirements. In most cases, the space required with these conventional weatherproofing doors for the water collection pans that are disposed within the ventilation unit behind the doors is not available with the more compact ventilation equipment. In addition, the partial pressure that exists on the inner side of the air intake increases the requirements on the rainproof design and sealing of the weatherproofing doors for the air intakes of ventilation equipment.

It is an object of the present invention, especially for the air intake of a ventilation unit where, due to the compact construction, the air intake and the components of the ventilation unit are disposed very close to one another and the water collection pans that are provided behind the doors of conventional weatherproofing screens cannot be used due to lack of space, to provide a weatherproofing door that for any direction of the wind, even during strong rainfall with wind gusts or eddies, reliably and dependably extracts the rain water from the air drawn in by the ventilating unit while nevertheless providing only a slight resistance to the flow of air therethrough. In addition, without door seals, for example in the form of resilient profiled rubber gaskets, that are required with the conventional weatherproofing doors to seal the edges of the door relative to the mounting frame that surrounds the air intake opening, the inventive weatherproofing door reliably prevents rain water from passing through the joint space between the door and the mounting frame.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

Figure 1:
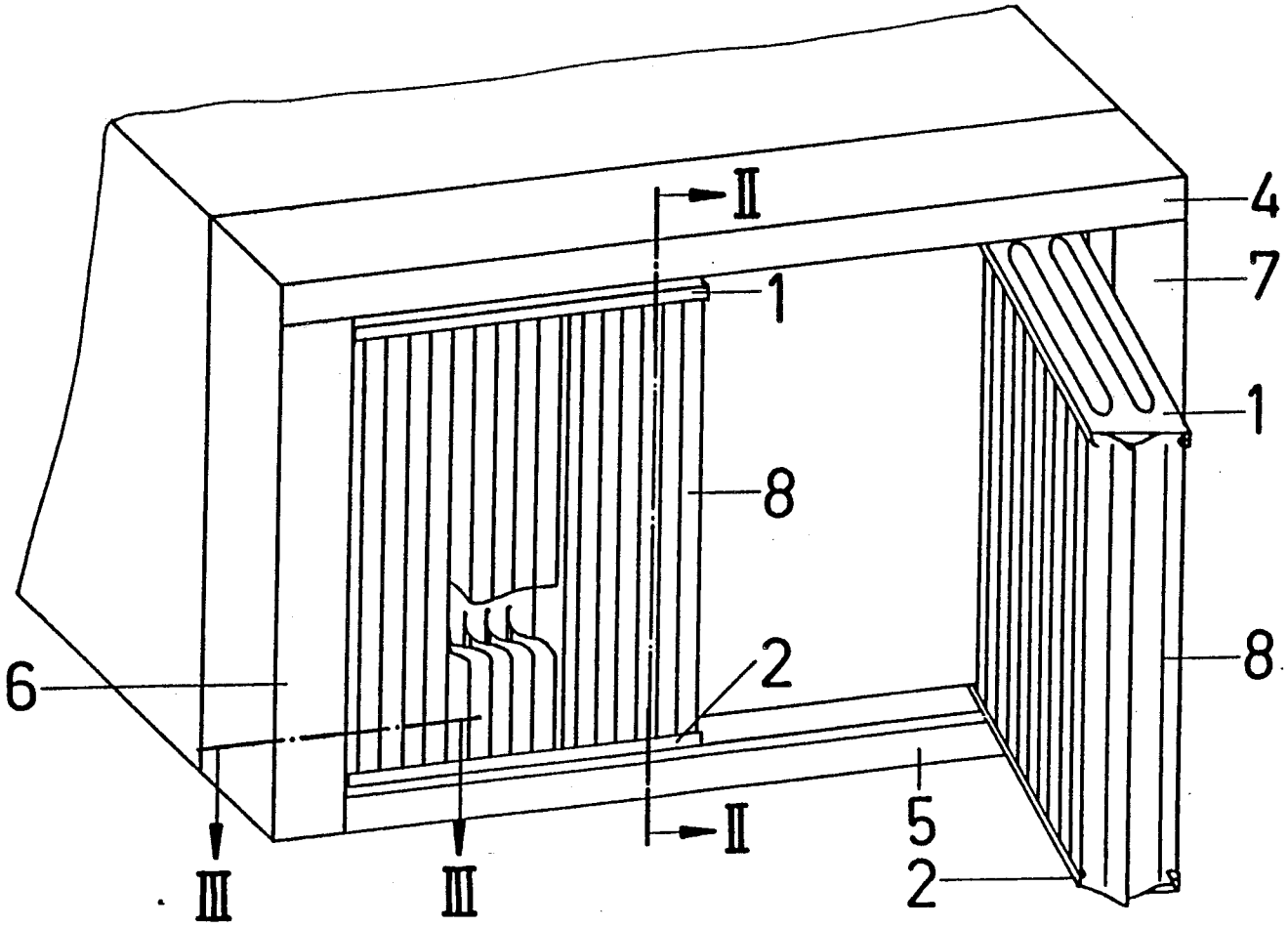
FIG. 1 is a perspective view of one preferred exemplary embodiment of the inventive weatherproofing door disposed in the air intake opening that is surrounded by a housing frame of the ventilation unit.
Figure 3:
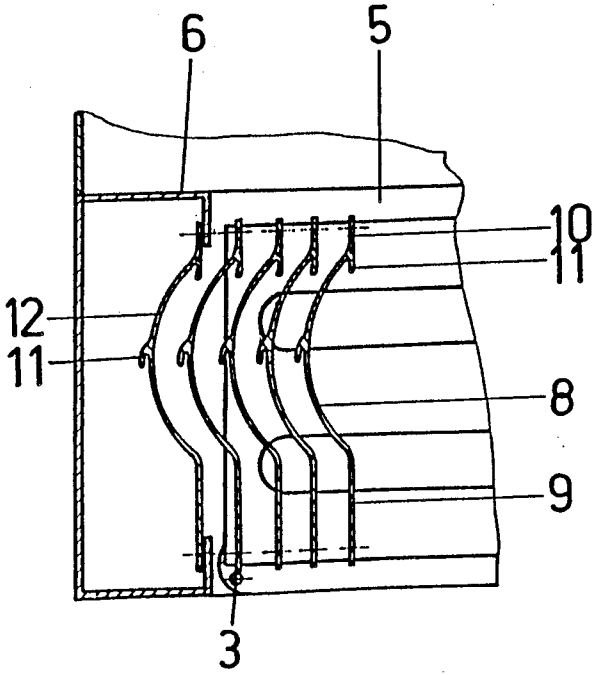
FIG. 3 is a horizontal cross-sectional view taken along the line III—III in FIG. 1.
Figure 2:
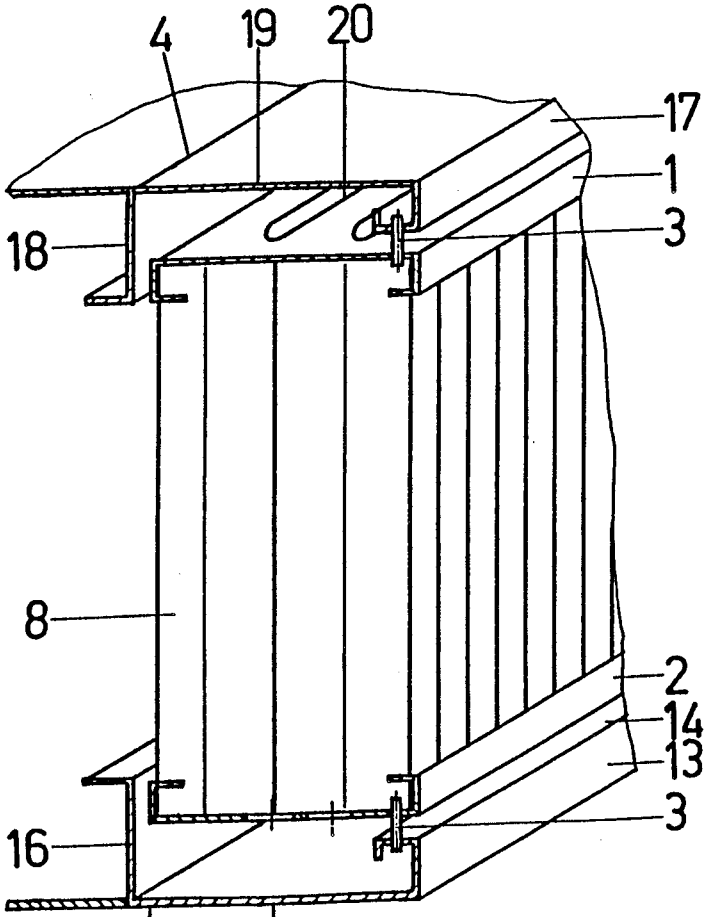
FIG. 2 is a partial perspective vertical cross-sectional view taken along the line II—II in FIG. 1.

The weatherproofing door of the present invention comprises: an upper horizontal doorframe section; a lower horizontal doorframe section, with the upper and lower doorframe sections being pivotable outwardly, about vertical door hinge pins, away from a housing frame that surrounds the air intake opening; and vertically extending fin-like or lamellar profiled drop-extracting members that are disposed next to one another and extend between the upper and lower doorframe sections, with the profiled drop-extracting members, between an outer side and an inner side of the door, having profile curvatures that are laterally directed in the same direction, with the height of the profiled curvatures, in a horizontal direction, being at least as great as a horizontal inside width or clear distance of air passages formed between adjacent ones of the profiled members, whereby the lower doorframe section is provided with water drain means that communicates with the air passages.

The use of the vertical profiled drop-extracting members as the weatherproofing door assures that even at a high extraction rate, the water extracted on each profiled member is conveyed directly vertically to the water drain means of the door, and the profiled shape or curvature of the profiled drop-extracting members can be selected in such a way that even unfavorable wind directions have no impact upon the completeness and reliability of the extraction proficiency.

Further advantageous specific embodiments of the present invention assure that without the need for a tightly closing contact between the door and the mounting frame that contains the air inlet opening, no rain water can get past the two vertical and the two horizontal door edges.

Further specific features of the present invention will be described in detail subsequently.

DESCRIPTION OF PREFERRED EMBODIMENTS

Referring now to the drawings in detail, each door wing of the weatherproofing door, which in the illustrated embodiment is of double-winged construction, comprises an upper horizontal doorframe section 1 and a lower horizontal doorframe section 2. The horizontal doorframe sections 1 and 2 can be pivoted outwardly about vertical door hinge pins 3 in a housing frame that surrounds the air intake opening and comprises the two horizontal housing frame sections 4 and 5 and the two vertical housing frame sections 6 and 7. Between the two horizontal doorframe sections 1 and 2, the weather-guard or weatherproofing door comprises vertically extending and fin-like or lamellar profiled drop-extracting members 8 that are disposed next to one another. Between the outer side of the door and the inner side of the door, these profiled drop-extracting members 8 have a profiled curvature that is laterally directed in the same direction. In the horizontal direction, the curvature has a height that is at least as great as the horizontal inside width of the air passages between the profiled members 8, so that in any wind direction in which, even in the most unfavorable situation, drops of water on the outside of the door enter the air passages, the drops of water are trapped and extracted by the profiled members 8 and cannot leave the air passages on the inside of the door.

In a particularly preferred manner, the profiled drop-extracting members 8 do not comprise only a single lamellar strip that between its two longitudinal edges is arched or is curved in some other similarly acting shape. Instead, adjoining that edge that faces the outer side of the door, the profiled drop-extracting members 8 first have a planar wall section 9 that is disposed essentially at right angles to the plane of the door, with adjacent wall sections 9 forming a linear calming region of the air passage; that wall portion of the profiled member 8 that is provided with the curvature then adjoins the wall section 9 in a direction toward the inner side of the door. This wall portion of the profiled member that is provided with the curvature preferably also extends to the inner side of the door via a planar edge strip 10 that is disposed at right angles to the plane of the door. By means of this profiling, streams of air that enter the air passages with rain are first calmed in order to therebY further increase the reliability and effectiveness of the extraction of drops of water at the curvatures of the profiled drop-extracting members 8. Pursuant to a further advantageous specific embodiment of the present invention, at the highest point of their convex curvature, and preferably also at that end of their concave curvature that is directed toward the inner side of the door, the profiled members 8 are provided with a vertically extending lip 11 that juts into the air passage and forms a U-shaped vertical extractor channel that is open toward the outer side of the door. These extractor channels prevent drops of water that have been extracted on that part of the curvature that is disposed ahead of the lips 11 from flowing on the surface of the profiled members 8 to the edge 10 that is disposed by the inner side of the door. The profiled drop-extracting members 8 can have built-in heating wires of a deicer, and, for example, can made of aluminum as a good heat conductor, in order thereby to assure in winter that the extractor channels formed by the lips 11 remain free of ice and snow.

A rainproof construction that obviates the need for special door seals in the gap of the vertical joint faces between the weatherproofing door and the housing frame that surrounds the air intake opening, pursuant to the present invention, is provided by disposing at both vertical housing frame sections 6, 7 a fixed profiled drop-extracting member 12 that conforms to the curvature of the profiled members 8 of the door and that, together with the adjacent profiled member 8 that forms the vertical edge of the door, forms an air passage that is in the form of a door gap and that is rainproof in the same manner as are the air passages that are formed between the profiled members 8 of the door. In the same manner as the air passages of the door, the air passage between the fixed profiled member 12 of the housing frame and the adjacent profiled member 8 of the door is also coupled with a water drain, which will be described in detail subsequently. On that vertical door edge that contains the door hinges, the two adjacent profiled members 12 and 8 pivot apart or together, about the pins 3, when the door is opened or closed. On the other vertical door edge, which can be swung out, the two analogous adjacent profiled members 8 can in a simple manner pass one another when the door is opened or closed in such a way that the door, as shown by the illustrated embodiment, is of double-wing construction, with the facing vertical edges of the two door wings being provided with cooperating profiled members 8, and with the two door wings being simultaneously opened from the closed position or being swung back into the closed position.

Furthermore, a rainproof construction that obviates the need for special door seals in the door gap of the horizontal joint facings between the weatherproofing door and the housing frame is realized pursuant to the present invention in that the lower horizontal housing frame section 5 comprises an essentially U-shaped, upwardly open hollow profile, and the upper horizontal housing frame section 4 comprises an essentially U-shaped downwardly open hollow profile. At the outer side of the door, the lower hollow housing profile 5 has a profiled wall 13 beyond which the lower doorframe section 2 can be pivoted out of the air inlet opening. The profiled wall 13 forms a narrow door gap with the lower doorframe section 2, preferably via a rim 14 that is bent in an approximately reversed U shape. The base 15 of the lower hollow frame profile 5 then forms with the lower doorframe section 2 a wide space that joins the narrow door gap and in which the stream of air that enters through the narrow door gap is calmed in such a way that the drops of water that are carried along by the entering stream of air fall to the base of the lower hollow frame profile 5, which is embodied and serves directly as a collection pan. Thus, the drops of water are extracted from the air and do not reach the separating or joint face between the lower doorframe section 2 and that wall 16 of the lower hollow frame profile 5 that is on the inner side of the door. This wall 16 of the lower hollow frame profile 5 expediently overlaps the lower doorframe section 2 in order to form a door abutment or stop for the inwardly pivoted lower doorframe section 2. Discharging into the water collecting space formed by the lower hollow frame profile 5 is the water drain through which flows the water that was extracted on, and ran down from, the profiled drop-extracting members 8 of the door and the stationary profiled drop-extracting members 12 of the housing frame.

In an analogous manner, the upper horizontal hollow frame profile 4 has at the outer side of the door a wall 17 that forms a narrow door gap with the upper doorframe section 1. The hollow frame profile 4 also has at the inside of the door a wall 18 that forms a door stop for the inwardly pivoted upper doorframe section 1. The upper hollow frame profile 4 furthermore has a base 19 that forms with the upper doorframe section 1 a wide space that joins the narrow door gap and calms the entering stream of air. Also in this space a stream of air that enters through the narrow door gap at the wall 17 at the outer side of the door is calmed to such an extent that drops of water that are carried along fall onto the upper side of the upper doorframe section 1. Thus, these drops of water are extracted from the air and will no longer be carried along by the air to the joint face between the doorframe section 1 and the wall 18 at the inner side of the door. The upper doorframe section 1 is provided with water outlets 20 in the form of longitudinal slots through which the extracted water that collects on the upper side of the upper horizontal doorframe section 1 can flow to the air passages disposed between the profiled drop-extracting members 8 of the door in order to then flow down along the profiled members 8 into the collection pan of the lower hollow frame profile 5. To form the water drain thereof, the lower horizontal doorframe section 2 can be provided with similar longitudinal slots through which the water that flows down along the profiled drop-extraction members 8 flows into the lower hollow frame profile 5.

The present invention is, of course, in no way restricted to the specific disclosure of the specification and drawings, but also encompasses any modifications within the scope of the appended claims.

What I claim is:

1. A weatherproofing door for an air intake opening of a ventilating unit, said door without any vertical door frame sections comprising:

only an upper horizontal doorframe section;

only a lower horizontal doorframe section, with said upper and lower doorframe sections being pivotable outwardly, about vertical door hinge pins, away from a housing frame that surrounds said air intake opening; and vertically extending, lamellar profiled drop-extracting members that are disposed next to one another and extend between said upper and lower doorframe sections, with said profiled drop-extracting members, between an outer side and an inner side of said door, having profile curvatures that are laterally directed in the same direction, with the height of the profiled curvatures, in a horizontal direction, being at least as great as a horizontal clear distance of air passages formed between adjacent ones of said profiled drop-extracting members, whereby said lower doorframe section is provided with water drain means that communicates with said air passages, said housing frame including two vertical sections formed directly by said drop-extracting members and on each of which is disposed a fixed profiled drop-extracting member that has a curvature that conforms to said curvature of said other profiled drop-extracting members, with an air passage formed between a given one of said fixed profiled drop-extracting member and an adjacent profiled member of said door also communicating with water drain means.

2. A weatherproofing door according to claim 1, in which each of said fixed and other profiled drop-extracting members, on the highest point of the convex side of said curvature thereof, is provided with a vertically extending lip that juts into said air passage and forms a U-shaped vertically extending extractor channel that is open toward said outer side of said door.

3. A weatherproofing door according to claim 2, in which an end of each concave side of said curvature of each profiled member that faces said inner side of said door is provided with a further vertically extending lip that juts into said air passage and forms a U-shaped vertically extending extractor channel that is open toward said outer side of said door.

4. A weatherproofing door according to claim 1, in which said housing frame further includes an upper and lower horizontal section, with said lower housing frame section comprising an essentially U-shaped, upwardly open hollow profile having a wall, at said outer side of said door, that forms a narrow gap with said lower horizontal doorframe section, which is disposed thereabove, and with said upper housing frame section comprising an essentially U-shaped, downwardly open hollow profile having a wall, at said outer side of said door, that forms a narrow gap with said upper horizontal doorframe section, which is disposed therebelow; in which said upper and lower hollow housing frame profiles, at said inner side of said door, have respective walls that form door stops for said upper and lower doorframe sections; and in which said upper and lower hollow housing frame profiles have respective bases that form with the pertaining doorframe section a wide space that calms an air stream entering through one of said narrow gaps, with said water drain means of said lower doorframe section opening into said wide space of said lower hollow housing frame profile, which lower wide space is embodied as a collection pan, and with said upper doorframe section being provided with water outlet means that lead from said wide space of said upper hollow housing frame profile to said air passages between said profiled drop-extracting members of said door.

5. A weatherproofing door for an air intake opening of a ventilating unit, said door comprising:

an upper horizontal doorframe section;

a lower horizontal doorframe section, with said upper and lower doorframe sections being pivotable outwardly, about vertical door hinge pins, away from a housing frame that surrounds said air intake opening; and vertically extending, lamellar profiled drop-extracting members that are disposed next to one another and extend between said upper and lower doorframe sections, with said profiled drop-extracting members, between an outer side and an inner side of said door, having profile curvatures that are laterally directed in the same direction, with the height of the profiled curvatures, in a horizontal direction, being at least as great as a horizontal clear distance of air passages formed between adjacent ones of said profiled drop-extracting members, whereby said lower doorframe section is provided with water drain means that communicates with said air passages, said housing frame including two vertical sections, on each of which is disposed a fixed profiled drop-extracting member that has a curvature that conforms to said curvature of said other profiled drop-extracting members, with an air passage formed between a given one of said fixed profiled drop-extracting member and an adjacent profiled member of said door also communicating with water drain means, said fixed and other profiled drop-extracting members each having a profile edge that is directed toward said outer side of said door and that is adjoined by a planar wall section that extends essentially perpendicular to the plane of said door, with a linear calming section of said air passage being formed between adjacent ones of said planar wall sections; a respective wall section that is provided with said profile curvature adjoins each planar wall section remote from said profile edge thereof that is directed toward said outer side of said door.

6. A weatherproofing door according to claim 5, in which each of said wall sections that is provided with said profile curvature is adjoined by a planar edge strip that extends to said inner side of said door and is disposed essentially perpendicular to the plane of said door.

* * * * *